US010781034B2

(12) United States Patent
Mustafa

(10) Patent No.: US 10,781,034 B2
(45) Date of Patent: Sep. 22, 2020

(54) PACK FOR SMOKING ARTICLES

(71) Applicant: British American Tobacco (Investments) Limited, London (GB)

(72) Inventor: Isaak Mustafa, London (GB)

(73) Assignee: BRITISH AMERICAN TOBACCO(INVESTMENTS) LIMITED, London (GB)

( * ) Notice: Subject to any disclaimer, the term of this patent is extended or adjusted under 35 U.S.C. 154(b) by 0 days.

(21) Appl. No.: 15/764,069

(22) PCT Filed: Sep. 26, 2016

(86) PCT No.: PCT/EP2016/072868
§ 371 (c)(1),
(2) Date: Mar. 28, 2018

(87) PCT Pub. No.: WO2017/055221
PCT Pub. Date: Apr. 6, 2017

(65) Prior Publication Data

US 2018/0319575 A1 Nov. 8, 2018

(30) Foreign Application Priority Data

Sep. 28, 2015 (GB) ..... 1517129.1

(51) Int. Cl.
*B65D 85/10* (2006.01)
*B65D 5/54* (2006.01)
*B65D 5/66* (2006.01)

(52) U.S. Cl.
CPC ..... *B65D 85/1045* (2013.01); *B65D 5/543* (2013.01); *B65D 5/662* (2013.01)

(58) Field of Classification Search
CPC ..... B65D 85/1045; B65D 85/1036; B65D 85/10; A24F 15/00; A24F 15/02; A24F 15/12

(Continued)

(56) References Cited

U.S. PATENT DOCUMENTS 4,923,059 A 5/1990 Evers
5,044,550 A * 9/1991 Lamm ..... B65B 19/24 206/245

(Continued)

FOREIGN PATENT DOCUMENTS

EP 2022729 A1 2/2009
EP 2789547 A1 10/2014
WO 2012019859 A1 2/2012

OTHER PUBLICATIONS

RU Office Action dated Oct. 17, 2018 re: Application No. 2018110823 (PCT/EP2016/072868), pp. 13, citing: U.S. Pat. No. 5,143,282 A, EP 2022729 A1, US 2013292279 A1, U.S. Pat. No. 5,066,270 A and U.S. Pat. No. 4,923,059 A.

(Continued)

*Primary Examiner* — Steven A. Reynolds
(74) *Attorney, Agent, or Firm* — Cantor Colburn LLP

(57) ABSTRACT

A pack for smoking articles including: a container having front, rear, first side and second side panels and curved edges connecting the front, rear, first side and second side panels the container defining a chamber for storing smoking articles and an opening through which smoking articles are removable from the chamber; an inner frame projecting through the opening from within the chamber, the inner frame having a front portion and first and second side portions (230, 250) extending from first and second sides of the front portion to respective free ends (280, 290) of the inner frame, wherein the free ends (280, 290) of the inner frame are spaced apart from the first and second side panels (130, 170) of the container and abut the rear panel of the container; and a lid having front, rear, first side and second side panels and curved edges connecting the front, rear, first side and second side panels of the lid, the lid defining a cavity, where the rear panel of the lid is hinged to the rear panel of the container so that the lid is movable relative to the container between (Continued)

a closed position, at which the lid blocks the opening with the inner frame projecting into the cavity of the lid, and an open position, at which the lid does not block the opening.

16 Claims, 5 Drawing Sheets

(58) Field of Classification Search
USPC ..... 206/268, 273
See application file for complete search history.

(56) References Cited

U.S. PATENT DOCUMENTS 5,066,270 A 11/1991 Tomanovits
5,143,282 A 9/1992 Pham
5,143,283 A 9/1992 Lancaster
5,478,011 A 12/1995 Pham
5,833,060 A * 11/1998 Draghetti ..... B65D 85/1045 206/268
6,059,099 A * 5/2000 Galbierz ..... B65D 71/42 206/151
6,343,691 B1 * 2/2002 Focke ..... B65D 85/1045 206/268
6,457,580 B1 * 10/2002 Focke ..... B65D 85/1045 206/259
6,591,982 B2 * 7/2003 Focke ..... B65D 85/1045 206/259
7,455,176 B2 * 11/2008 Focke ..... B65D 85/1045 206/268
8,418,846 B2 * 4/2013 Tanbo ..... B65D 5/4266 206/268
8,608,051 B2 * 12/2013 Focke ..... B65D 5/029 206/259
2002/0179464 A1 * 12/2002 Focke ..... B65D 85/1045 206/259
2004/0055909 A1 * 3/2004 Gamberi ..... B65D 5/6691 206/271
2004/0099656 A1 * 5/2004 Sauter ..... F24C 7/082 219/492
2004/0144661 A1 * 7/2004 Lutzig ..... B65D 5/6691 206/268
2005/0224375 A1 * 10/2005 Focke ..... B65D 85/1045 206/259
2006/0191986 A1 8/2006 Focke
2006/0226208 A1 10/2006 Focke
2009/0078599 A1 * 3/2009 Tanbo ..... B65D 5/4266 206/259
2013/0206618 A1 * 8/2013 Holford ..... B65D 5/6685 206/268
2013/0292279 A1 11/2013 Bengtsson et al.

OTHER PUBLICATIONS

British Search Report for corresponding application GB1517129.1; Report dated Nov. 9, 2015.

* cited by examiner

PACK FOR SMOKING ARTICLES

TECHNICAL FIELD

The present invention relates to packs for smoking articles, such as cigarettes, and to blanks that are locatable relative to each other to form such packs.

BACKGROUND

Smoking articles, such as cigarettes, may be provided in a pack comprising a container and a lid. The container defines a chamber for storing the smoking articles and an opening through which the smoking articles are removable from the chamber, and the lid is for selectively blocking the opening.

SUMMARY

A first aspect of the present invention provides a pack for smoking articles, the pack comprising:

a container having front, rear, first side and second side panels and curved edges connecting the front, rear, first side and second side panels, the container defining a chamber for storing smoking articles and an opening through which smoking articles are removable from the chamber;

an inner frame projecting through the opening from within the chamber, the inner frame having a front portion and first and second side portions extending from first and second sides of the front portion to respective free ends of the inner frame, wherein the free ends of the inner frame are spaced apart from the first and second side panels of the container and abut the rear panel of the container; and a lid having front, rear, first side and second side panels and curved edges connecting the front, rear, first side and second side panels of the lid, the lid defining a cavity;

wherein the rear panel of the lid is hinged to the rear panel of the container so that the lid is movable relative to the container between a closed position, at which the lid blocks the opening with the inner frame projecting into the cavity of the lid, and an open position, at which the lid does not block the opening.

In an exemplary embodiment, the first and second side portions of the inner frame abut the first side and second side panels, respectively, of the container.

In an exemplary embodiment, each of the first and second side portions of the inner frame has a first part and a second part; and the first parts are substantially parallel to and abut the first and second side panels, respectively, of the container, and the second parts are spaced apart from the first and second side panels, respectively, of the container and comprise the free ends of the inner frame.

In an exemplary embodiment, the second parts are substantially parallel to the front portion of the inner frame.

In an exemplary embodiment, the second parts are substantially parallel to the rear panel of the container.

In an exemplary embodiment, the second parts abut the rear panel of the lid when the lid is at the closed position.

In an exemplary embodiment, each of the first and second side portions of the inner frame comprises a curved edge or at least one bevelled edge connecting the first and second parts.

In an exemplary embodiment, each of the first and second parts is planar.

In an exemplary embodiment, the front, rear, first side and second side panels of the container and of the lid are planar.

In an exemplary embodiment, respective widths of the front, rear, first side and second side panels of the lid measured between the curved edges of the lid are equal to respective widths of the front, rear, first side and second side panels of the container measured between the curved edges of the container; and respective radii of the curved edges of the lid between the front and first side panels of the lid, the rear and first side panels of the lid, the front and second side panels of the lid, and the rear and second side panels of the lid are equal to respective radii of the curved edges of the container between the front and first side panels of the container, the rear and first side panels of the container, the front and second side panels of the container, and the rear and second side panels of the container.

In an exemplary embodiment, the front portion of the inner frame is substantially parallel to and abuts the front panel of the container.

In an exemplary embodiment, the front portion of the inner frame is affixed to the front panel of the container.

In an exemplary embodiment, the free ends of the inner frame are spaced apart from each other.

In an exemplary embodiment, the inner frame is made from a laminate material.

In an exemplary embodiment, the container and/or lid is made from fibrous material in which a majority or all fibres of the fibrous material are substantially parallel to longitudinal directions of the curved edges of the container and/or lid, respectively.

In an exemplary embodiment, the pack comprises a bundle of smoking articles in the chamber, and the inner frame extends at least partially around the bundle of smoking articles.

In an exemplary embodiment, the bundle comprises the smoking articles and a wrapper extending at least partially around the smoking articles.

A second aspect of the present invention provides a plurality of blanks, wherein each of the blanks comprises a sheet of material having one or more predetermined fold lines therein, and wherein the blanks are foldable along the fold lines and locatable relative to each other to form a pack according to the first aspect of the present invention.

BRIEF DESCRIPTION OF THE DRAWINGS

Embodiments of the invention will now be described, by way of example only, with reference to the accompanying drawings, in which.

DETAILED DESCRIPTION

Figure 1:
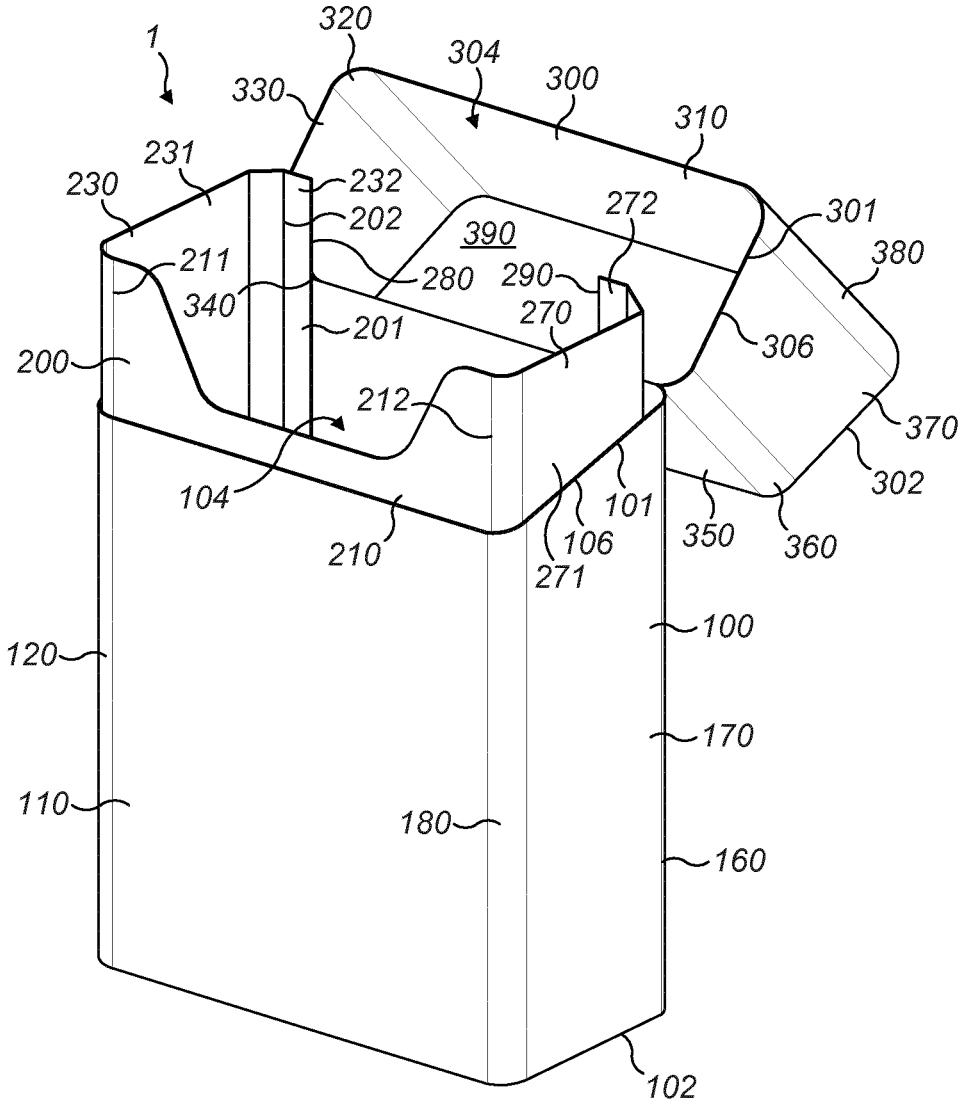
FIG. 1 shows a schematic perspective view of a pack.
Figure 2:
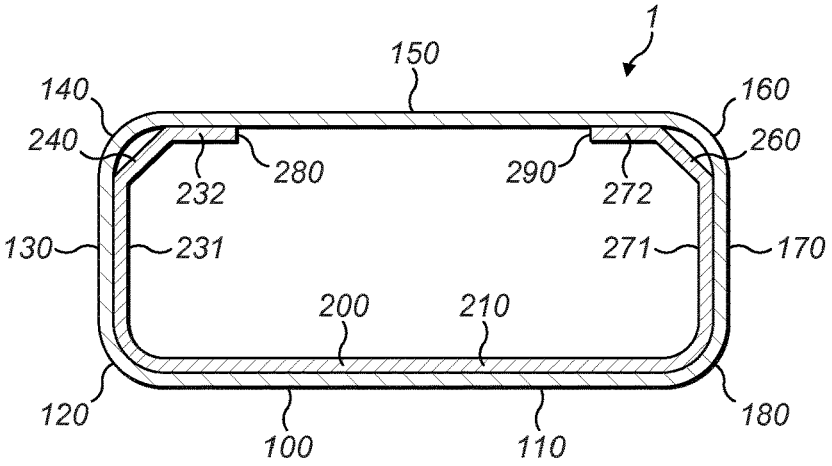
FIG. 2 shows a schematic cross-sectional view of a container and an inner frame of the pack of FIG. 1.

Referring to FIG. 1, there is shown a schematic perspective view of an example of a pack 1 according to an embodiment of the invention. The pack 1 is a pack for smoking articles, such as cigarettes, cigars or cigarillos. The pack 1 of this example comprises a container 100, an inner frame 200, and a lid 300. Referring to FIG. 2, there is shown a schematic cross-sectional view of the container 100 and the inner frame 200 of the pack 1 of FIG. 1.

The container 100 comprises a front panel 110, a rear panel 150, a first side panel 130, a second side panel 170, and an end panel (not shown). In this example, the front and rear panels 110, 150 are opposing major panels of the container 100, whereas the first and second side panels 130, 170 are opposing minor panels of the container 100. The container 100 also comprises curved edges 120, 140, 160, 180 that connect the front, rear, first side and second side panels 110, 150, 130, 170 of the container 100. More specifically, in this example, each of the curved edges 120, 140, 160, 180 of the container 100 connects respective adjacent pairs of the front, rear, first side and second side panels 110, 150, 130, 170 of the container 100. In this example, the container 100 comprises a first curved edge 120 connecting the front panel 110 to the first side panel 130, a second curved edge 140 connecting the first side panel 130 to the rear panel 150, a third curved edge 160 connecting the rear panel 150 to the second side panel 170, and a fourth curved edge 180 connecting the second side panel 170 to the front panel 110.

The container 100 defines or delineates a chamber 104 for storing smoking articles, such as cigarettes, cigars or cigarillos. The container 100 also defines an opening 106 through which smoking articles are removable from the chamber 104 in use. In this example, the opening 106 is at a first end 101 of the container 100, and the end panel (not shown) is at a second end 102 of the container 100 opposite from the first end 101 of the container 100. Thus, in this example, the first end 101 of the container 100 is an open end 101 of the container 100, and the second end 102 of the container 100 is a closed end 102 of the container 100.

In this example, the container 100 is elongate, and each of the front, rear, first side and second side panels 110, 150, 130, 170 of the container 100 is elongate in the longitudinal direction of the container 100. Moreover, in this example, each of the first to fourth curved edges 120, 140, 160, 180 of the container 100 is elongate in the longitudinal direction of the container 100. That is, each of the first to fourth curved edges 120, 140, 160, 180 has a longitudinal direction that is parallel to the longitudinal direction of the container 100. In this example, the longitudinal direction of each of the first to fourth curved edges 120, 140, 160, 180 of the container 100 is substantially normal to the radius of curvature of the respective first to fourth curved edges 120, 140, 160, 180 of the container 100. In this example, each of the first to fourth curved edges 120, 140, 160, 180 of the container 100 has a radius of curvature that is substantially constant along the full length of the respective curved edge.

The inner frame 200 projects through the opening 106 of the container 100 from within the chamber 104 of the container 100. Therefore, in this example, a first portion 201 of the inner frame 200 is located in the chamber 104 and a second portion 202 of the inner frame 200 is located outside the chamber 104. The inner frame 200 comprises a front portion 210, a first side portion 230 that extends from a first side 211 of the front portion 210, and a second side portion 250 that extends from a second side 212 of the front portion 210. In this example, the front portion 210 is parallel to and abuts the front panel 110 of the container 100. In some examples, the front portion 210 of the inner frame 200 may be affixed to the front panel 110 of the container 100, such as by an adhesive. In this example, a top edge of the front portion is non-linear and defines a cut-out into the front portion 210 of the inner frame, for aiding the removal of smoking articles from the pack 10 in use.

In this example, the first side portion 230 of the inner frame 200 abuts the first side panel 130 of the container 100, and the second side portion 270 of the inner frame 200 abuts the second side panel 170 of the container 100. The first and second side portions 230, 270 of the inner frame 200 extend from the first and second sides 211, 212 of the front portion 210 to respective free ends 280, 290 of the inner frame 200. The free ends 280, 290 of the inner frame 200 will be described further below. In some examples, the first and second side portions 230, 270 of the inner frame 200 may be respectively affixed to the first and second side panels 130, 170 of the container 100, such as by an adhesive.

The lid 300 comprises a front panel 310, a rear panel 350, a first side panel 330, a second side panel 370, and an end panel 390. In this example, the front and rear panels 310, 350 of the lid 300 are opposing major panels of the lid 300, whereas the first and second side panels 330, 370 of the lid 300 are opposing minor panels of the lid 300. The lid 300 also comprises curved edges 320, 340, 360, 380 that connect the front, rear, first side and second side panels 310, 350, 330, 370 of the lid 300. More specifically, in this example, each of the curved edges 320, 340, 360, 380 of the lid 300 connects respective adjacent pairs of the front, rear, first side and second side panels 310, 350, 330, 370 of the lid 300. So, in this example, the lid 300 comprises a first curved edge 320 connecting the front panel 310 to the first side panel 330, a second curved edge 340 connecting the first side panel 330 to the rear panel 350, a third curved edge 360 connecting the rear panel 350 to the second side panel 370, and a fourth curved edge 380 connecting the second side panel 370 to the front panel 310.

The lid 300 defines or delineates a cavity 304 and defines an aperture 306 into the cavity 304. In this example, the aperture 306 is at a first end 301 of the lid 300, and the end panel 390 of the lid 300 is at a second end 302 of the lid 300 opposite from the first end 301 of the lid 300. Thus, in this example, the first end 301 of the lid 300 is an open end of the lid 300, and the second end 302 of the lid 300 is a closed end of the lid 300.

In this example, the rear panel 350 of the lid 300 is hinged to the rear panel 150 of the container 100, so that the lid 300 is movable relative to the container 100 between a closed position and an open position. That is, the rear panel 350 of the lid 300 is connected to the rear panel 150 of the container 100 by a hinge. In this example, the container 100 and the lid 300 are unitary. In this example, the hinge is a living hinge. In some examples, the hinge may be other than a living hinge. In FIG. 1, the lid 300 is shown in the open position.

When the lid 300 is at the closed position relative to the container 100, the lid blocks the opening 106 of the container 100. Moreover, when the lid 300 is at the closed position relative to the container 100, the inner frame 200 projects into the cavity 304 of the lid 300. That is, in this example, at least part of the second portion 202 of the inner frame 200 projects into the cavity 304 of the lid 300 via the aperture 306, when the lid 300 is at the closed position. This may help to give the pack 1 rigidity when the lid 300 is at the closed position. When the lid 300 is at the open position relative to the container 100, the lid 300 does not block the opening 106 of the container 100. In this example, when the lid 300 is at the open position, the chamber 104 of the container 100 is accessible from an exterior of the pack 1 via the opening 106, so that, in use, a user is able to remove a smoking article from the chamber 104 via the opening 106. In contrast, when the lid is at the closed position in this example, the lid 300 hinders or prevents access to the chamber 104 of the container 100 from the exterior of the pack 1 via the opening 106. Therefore, in use, smoking articles may be prevented from inadvertently falling out of the chamber 104, such as when the pack 1 is being transported.

In this example, the free ends 280, 290 of the inner frame 200 are spaced apart from the first and second side panels 130, 170 of the container 100. This helps to avoid the first and second side panels 330, 370 of the lid 300 contacting the free ends 280, 290 of the inner frame 200 as the lid 300 is moved relative to the container 100 from the open position to the closed position. That is, in this example, the lid 300 is movable relative to the container 100 from the open position to the closed position without the first and second side panels 330, 370 of the lid 300 contacting the free ends 280, 290 of the inner frame 200. This helps to avoid movement of the lid 300 from the open position to the closed position being hindered or prevented by the free ends 280, 290 of the inner frame 200.

In this example, the front, rear, first side and second side panels 110, 150, 130, 170, 310, 350, 330, 370 of the container 100 and of the lid 300 are planar. Thus, the pack 1 has a substantially cuboid appearance, aside from the curved edges 120, 140, 160, 180, 320, 340, 360, 380 of the container 100 and of the lid 300.

In this example, respective widths of the front, rear, first side and second side panels 310, 350, 330, 370 of the lid 300 measured between the curved edges 320, 340, 360, 380 of the lid 300 are equal to respective widths of the front, rear, first side and second side panels 110, 150, 130, 170 of the container 100 measured between the curved edges 120, 140, 160, 180 of the container 100. Moreover, in this example, respective radii of the curved edges 320, 340, 360, 380 of the lid 300 between the front and first side panels 310, 330 of the lid 300, the rear and first side panels 350, 330 of the lid 300, the front and second side panels 310, 370 of the lid 300, and the rear and second side panels 350, 370 of the lid 300 are equal to respective radii of the curved edges of the container 100 between the front and first side panels 110, 130 of the container 100, the rear and first side panels 150, 130 of the container 100, the front and second side panels 110, 170 of the container 100, and the rear and second side panels 150, 170 of the container 100. Therefore, in this example, when the lid 300 is at the closed position, the front, rear, first side and second side panels 110, 150, 130, 170 of the container 100 and the first to fourth curved edges 120, 140, 160, 180 of the container 100 respectively align with the front, rear, first side and second side panels 310, 350, 330, 370 of the lid 300 and the first to fourth curved edges 320, 340, 360, 380 of the lid 300. This helps to give the pack 1 rigidity and a neat appearance when the lid 300 is at the closed position.

In this example, the first side portion 230 of the inner frame 200 has a first part 231 and a second part 232. Moreover, in this example, the second side portion 270 of the inner frame 200 has a first part 271 and a second part 272. The respective second parts 232, 272 of the first and second side portions 230, 270 comprise the free ends 280, 290 of the inner frame 200. The first parts 231, 271 of the first and second side portions 230, 270 are substantially parallel to and abut the first and second side panels 130, 170, respectively, of the container 100, and the second parts 232, 272 of the first and second side portions 230, 270 are spaced apart from the first and second side panels 130, 170, respectively.

In some examples, such as the pack 1 shown in FIGS. 1 and 2, the first and second side portions 230, 270 of the inner frame 200 comprise respective curved edges that extend from the first and second sides 211, 212 of the front portion 210, respectively. In other examples, each of these curved edges may be replaced by a bevelled edge or a plurality of bevelled edges. In some examples, the first and second side portions 230, 270 of the inner frame 200 may meet the front portion 210 of the inner frame 200 at respective right angles.

Figure 3:
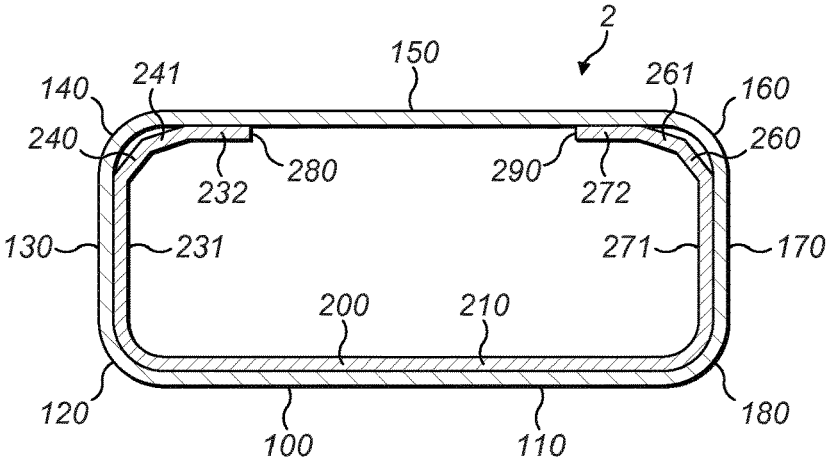
FIG. 3 shows a schematic cross-sectional view of a container and an inner frame of another pack.

In the example shown in FIGS. 1 and 2, each of the first and second side portions 230, 270 of the inner frame 200 comprises a respective bevelled edge 240, 260 connecting the first and second parts 231, 271, 232, 272. In other examples, which are respective variations to the example shown in FIGS. 1 and 2, each of the first and second side portions 230, 270 of the inner frame 200 may comprise a respective plurality of bevelled edges 240, 241, 260, 261 connecting the first and second parts 231, 271, 232, 272, as shown by way of example in FIG. 3. FIG. 3 shows a schematic cross-sectional view of a container 100 and an inner frame 200 of a pack 2 that is the same as the pack 1 shown in FIGS. 1 and 2, except for the provision of the respective pluralities of bevelled edges 240, 241, 260, 261 connecting the first and second parts 231, 271, 232, 272 of the inner frame 200, in place of the respective bevelled edges 240, 260 connecting the first and second parts 231, 271, 232, 272 of the inner frame 200 of FIG. 2.

Figure 4:
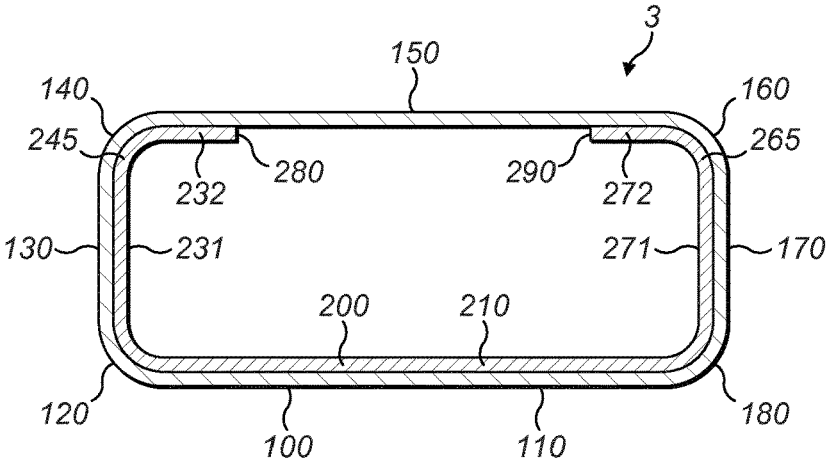
FIG. 4 shows a schematic cross-sectional view of a container and an inner frame of a further pack.

In other examples, which are further respective variations to the example shown in FIGS. 1 and 2, instead of bevelled edge(s), each of the first and second side portions 230, 270 of the inner frame 200 may comprise a respective curved edge 245, 265 connecting the first and second parts 231, 271, 232, 272, as shown by way of example in FIG. 4. FIG. 4 shows a schematic cross-sectional view of a container 100 and an inner frame 200 of a pack 3 that is the same as the pack 1 shown in FIGS. 1 and 2, except for the provision of the respective curved edges 245, 265 connecting the first and second parts 231, 271, 232, 272 of the inner frame 200, in place of the respective bevelled edges 240, 260 connecting the first and second parts 231, 271, 232, 272 of the inner frame 200 of FIG. 2. In some such examples, each of these curved edges 245, 265 of the inner frame 200 may have a radius that is slightly less than a respective radius of the second and third curved edges 140, 160 of the container 100, so that the curved edges 245, 265 of the inner frame 200 may nest with the second and third curved edges 140, 160 of the container 100.

In some examples, the first and second parts 231, 232 of the first side portion 230 of the inner frame 200 may instead meet at a right angle or an acute angle. Similarly, in some examples, the first and second parts 271, 272 of the second side portion 270 of the inner frame 200 may instead meet at a right angle or an acute angle.

In some examples, such as the packs 1, 2, 3 shown in FIGS. 1 to 4, the respective second parts 232, 272 of the first and second side portions 230, 270 are substantially parallel to the front portion 210 of the inner frame 200. In some such examples, the front portion 210 of the inner frame 200 and the respective second parts 232, 272 of the first and second side portions 230, 270 may be located on opposite sides of a bundle of smoking articles when the bundle is located in the chamber 104 of the container 100.

In some examples, such as the packs 1, 2, 3 shown in FIGS. 1 to 4, the second parts 232, 272 of the first and second side portions 230, 270 are substantially parallel to, and abut, the rear panel 150 of the container 100. In some examples, this arrangement helps to increase rigidity of the container 100. In some examples, such as the packs 1, 2, 3 shown in FIGS. 1 to 4, the second parts 232, 272 of the first and second side portions 230, 270 abut the rear panel 350 of the lid 300 when the lid is at the closed position. In some examples, this arrangement helps to increase rigidity of the pack 1, 2, 3 when the lid 300 is at the closed position.

In other examples, some of which are respective variations to the examples shown in FIGS. 1 to 4, the first and second side portions 230, 270 of the inner frame 200 do not abut, or are spaced from, the first side and second side panels 130, 170, respectively, of the container 100.

In the examples discussed above, each of the first and second parts 231, 271, 232, 272 of the first and second side portions 230, 270 of the inner frame 200 is planar. In other examples, this may not be the case. For example, in some examples, the first parts 231, 271 may be non-planar, such as curved. In some examples, the second parts 232, 272 may be non-planar, such as curved.

In some examples, the first parts 231, 271 of the first and second side portions 230, 270 of the inner frame 200 may be respectively affixed to the first and second side panels 130, 170 of the container 100, such as by an adhesive.

In the examples discussed above, the free ends 280, 290 of the inner frame 200 are spaced apart from each other. Accordingly, less material need be used to form the inner frame 200. However, in some examples, the free ends 280, 290 of the inner frame 200 may contact each other. This may help provide added protection for contents of the pack 1, 2, 3 in use.

In the packs 1, 2, 3 shown in FIGS. 1 to 4, the free ends 280, 290 of the inner frame 200 abut the rear panel 150 of the container 100. This helps to ensure that movement of the lid 300 from the open position to the closed position is not hindered or prevented by the free ends 280, 290 of the inner frame 200 through contact of the free ends 280, 290 with, for example, the first and second side panels 330, 370 of the lid 300. In some examples, the free ends 280, 290 of the inner frame 200 may be affixed to the rear panel 150 of the container 100, such as by an adhesive.

Figure 5:
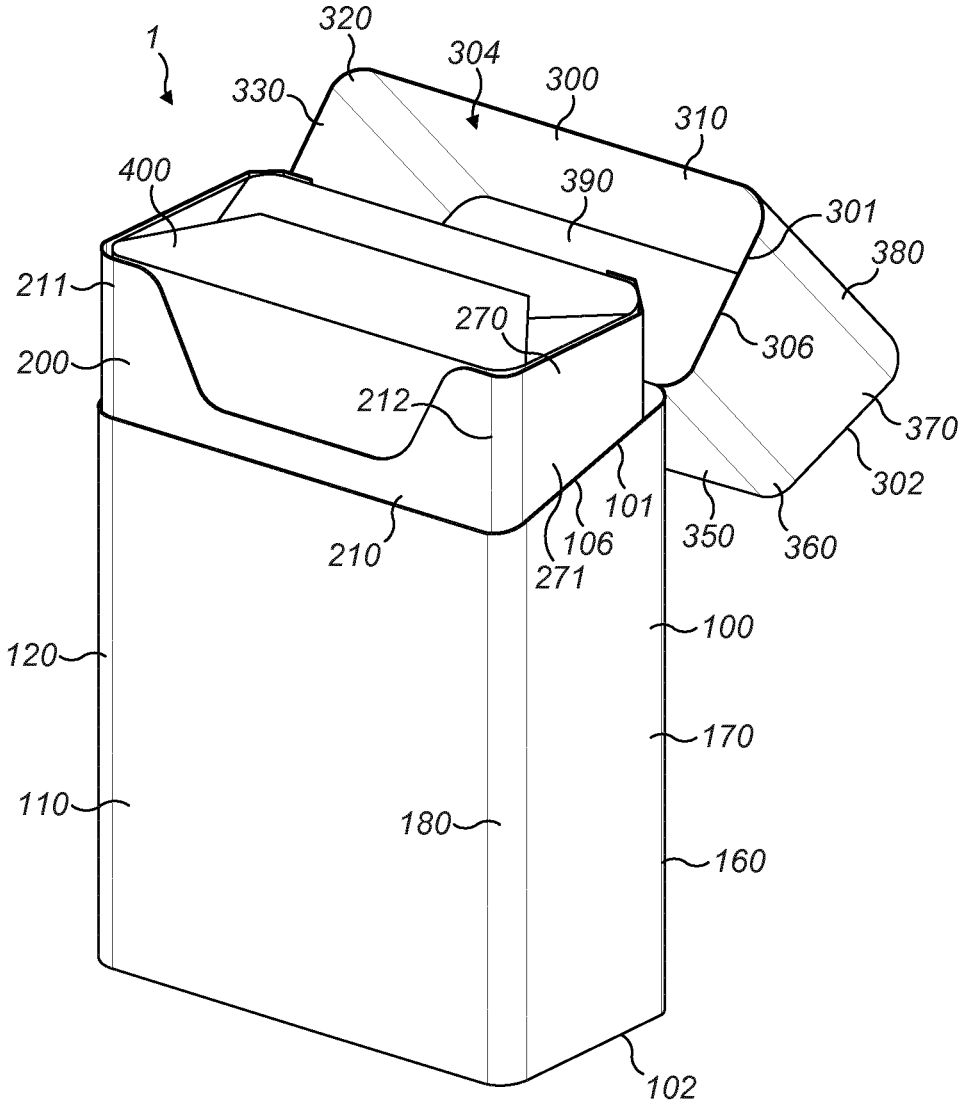
FIG. 5 shows a schematic perspective view of the pack of FIG. 1 with a bundle of smoking articles in a chamber of the container.

In some examples, such as respective variations to each of the packs 1, 2, 3 shown in FIGS. 1 to 4, the pack 1, 2, 3 may comprise a bundle of smoking articles in the chamber 104 of the container 100. In some examples, the inner frame 200 may extend partially, at least partially, or fully around the bundle of smoking articles. In some examples, the bundle comprises the smoking articles and a wrapper extending partially, at least partially, or fully around the smoking articles. The wrapper may be made of a barrier material, such as a material comprising a metallic foil. The wrapper may be hermetically sealed to preserve the smoking articles. The wrapper may be removable to access the smoking articles, or the wrapper may be re-closable once opened to access the smoking articles. FIG. 5 shows the pack 10 of FIG. 1 with a bundle of smoking articles in the chamber 104. The bundle comprises the smoking articles and a wrapper 400 extending at least partially around the smoking articles. Since the free ends 280, 290 of the inner frame 200 are spaced apart, the inner frame 200 of the pack 10 extends partially around the bundle of smoking articles.

In some examples, such as each of the packs 1, 2, 3 shown in FIGS. 1 to 4, the inner frame 200 may be made from a laminate material, such as laminated paper, laminated card, paperboard, cardboard, or the like. In some such examples, the free ends 280, 290 of the inner frame 200 may be prone to delaminating if rubbed or knocked, and particularly if knocked end-on. Such delamination may hinder subsequent relative movement of the lid 300 and container 100, may weaken the inner frame 200 or the pack 1, 2, 3, and may lessen the visual appeal of the pack 1, 2, 3. By spacing the free ends 280, 290 of the inner frame 200 apart from the first and second side panels 130, 170 of the container 100, the first and second side panels 330, 370 of the lid 300 are less likely to contact, rub or knock the free ends 280, 290 of the inner frame 200 during movement of the lid 300 relative to the container 100 from the open position to the closed position. Thus, this helps to reduce the risk of the inner frame 200 delaminating during use of the pack 1, 2, 3.

In some examples, the container 100 and/or the lid 300 may be made from a fibrous material in which a majority or all of the fibres of the fibrous material are oriented substantially parallel to longitudinal directions of the curved edges of the container 100 and/or lid 300, respectively. For example, in each of the packs 1, 2, 3 shown in FIGS. 1 to 5, the container 100 and the lid 300 are made from such fibrous material. The fibrous material may be, for example, paper, card, paperboard, cardboard, or the like. This fibre orientation may help to enable a smooth curvature to be provided to the curved edges of the container 100 and/or lid 300, respectively, during manufacture. However, such fibre orientation may also result in the container 100 and/or lid 300 having less structural rigidity than a container 100 and/or lid 300, respectively, made from an alternative material or having edges other than curved edges. Accordingly, the container 100 and/or lid 300 may be more prone to flexing, particularly when the pack 1, 2, 3 is being manipulated to move the lid 300 relative to the container 100 to the closed position. Thus, in such examples, the provision of the feature that the free ends 280, 290 of the inner frame 200 are spaced apart from the first and second side panels 130, 170 of the container 100 further helps to avoid the first and second side panels 330, 370 of the lid 300 contacting the free ends 280, 290 of the inner frame 200 as the lid 300 is moved from the open position to the closed position, which could risk delamination of the inner frame 200.

Figure 6:
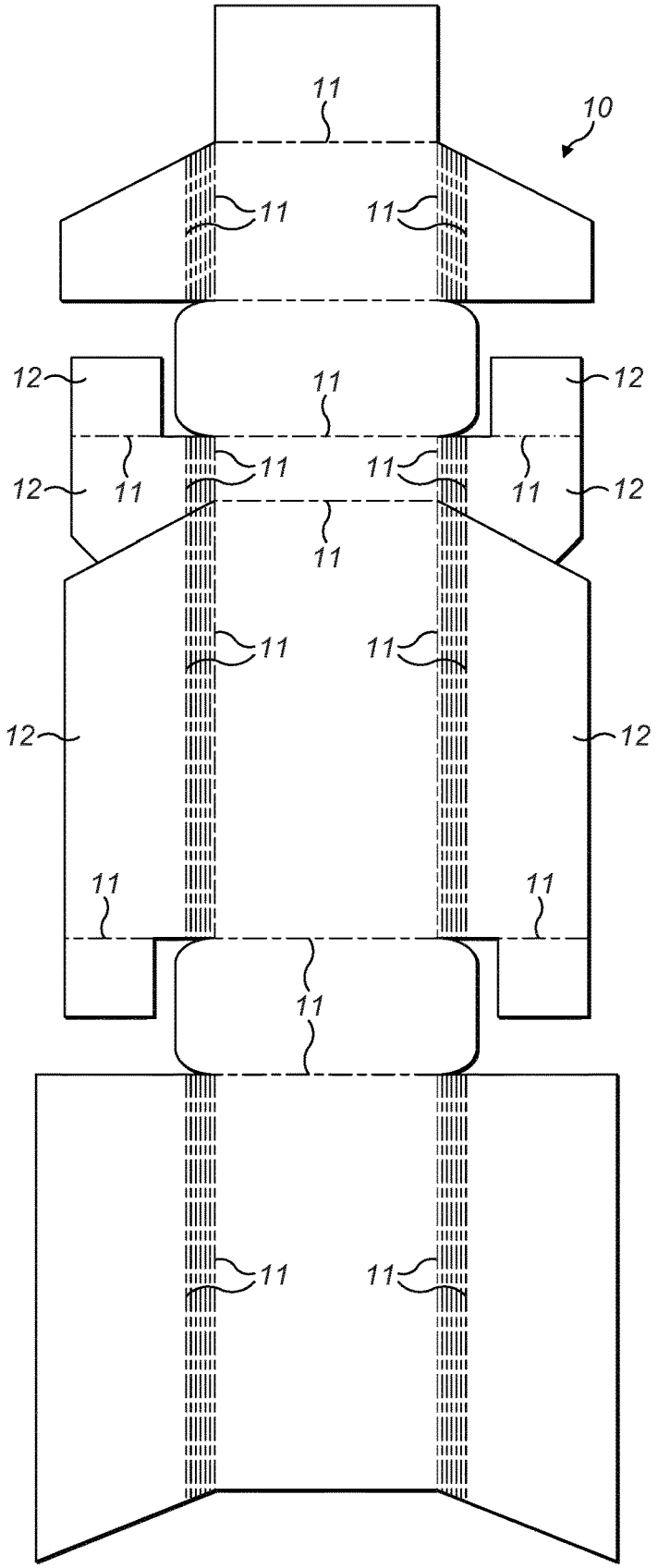
FIG. 6 shows a blank from which a combination of the container and a lid of the pack shown in FIG. 1 may be formed.

The combination of the container 100 and the lid 300 of the pack 1 of FIGS. 1 and 2 may be formed from the blank 10 shown in FIG. 6. The blank 10 comprises a sheet of material, such as paper, card, paperboard, cardboard, or the like, which has a plurality of fold lines 11 therein. The blank 10 may have been cut from a larger sheet of the material. The blank 10 is foldable along the fold lines 11 to form the combination of the container 100 and the lid 300. The curved edges 120, 140, 160, 180 of the container 100, and the curved edges 320, 340, 360, 380 of the lid 300, may be formed by bending or folding the blank 10 at a plurality of closely-spaced fold lines or lines of weakness. In this example, the blank 10 includes a plurality of tabs 12 there are fixable, by adhesive or otherwise, to other portions of the blank 10 to hold the material in the desired final configuration. The inner frame 200 of the pack 1 of FIGS. 1 and 2 may be formed from the blank 20 shown in FIG. 7. The blank 20 comprises a sheet of material, such as paper, card, paperboard, cardboard, or the like, which has a plurality of fold lines 21 therein. The blank 20 may have been cut from a larger sheet of the material. The blank 20 is foldable along the fold lines 21 to form the inner frame 200. The blanks 10, 20 may be foldable along the fold lines 11, 21 and locatable relative to each other to form the pack 1 shown in FIGS. 1 and 2.

The respective containers 100 of the packs 2, 3 of FIGS. 3 and 4 may be formed from the blank 10 shown in FIG. 6.

Figure 7:
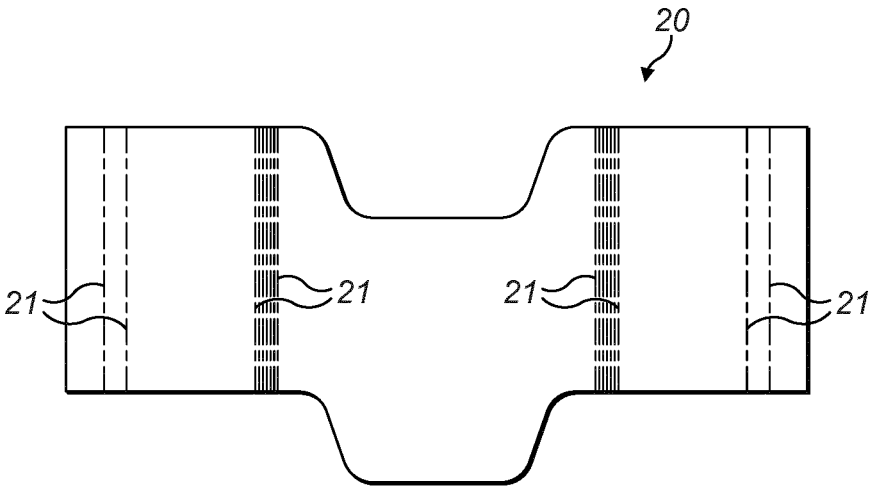
FIG. 7 shows a blank from which the inner frame of the pack shown in FIG. 1 may be formed.

The respective inner frames 200 of the packs 2, 3 of FIGS. 3 and 4 may be formed from suitably modified respective versions the blank 20 shown in FIG. 7. Those blanks 10, 20 may then be foldable along the fold lines 11, 21 and locatable relative to each other to form one of the packs 2, 3 shown in FIGS. 3 and 4.

In order to address various issues and advance the art, the entirety of this disclosure shows by way of illustration and example various embodiments in which the claimed invention may be practised and which provide for superior packs for smoking articles and blanks for forming such packs. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. A pack for smoking articles, the pack comprising:

a container having front, rear, first side and second side panels and curved edges connecting the front, rear, first side and second side panels, the container defining a chamber for storing smoking articles and an opening through which smoking articles are removable from the chamber;

an inner frame projecting through the opening from within the chamber, the inner frame having a front portion and first and second side portions extending from first and second sides of the front portion to respective free ends of the inner frame, the inner frame being made from a laminate material selected from laminated card, paperboard, and cardboard; and a lid having front, rear, first side and second side panels and curved edges connecting the front, rear, first side and second side panels of the lid, the lid defining a cavity;

wherein the rear panel of the lid is hinged to the rear panel of the container so that the lid is movable relative to the container between a closed position, at which the lid blocks the opening with the inner frame projecting into the cavity of the lid, and an open position, at which the lid does not block the opening;

the free ends of the inner frame are spaced apart from the first and second side panels of the container and abut the rear panel of the container, whereby the inner frame has a reduced risk of being delaminated during movement of the lid relative to the container from the open position to the closed position; and the container and/or lid is made from fibrous material in which a majority or all fibers of the fibrous material are substantially parallel to longitudinal directions of the curved edges of the container and/or lid, respectively.

2. The pack of claim 1, wherein the first and second side portions of the inner frame abut the first side and second side panels, respectively, of the container.

3. The pack of claim 2, wherein each of the first and second side portions of the inner frame has a first part and a second part; and wherein the first parts are substantially parallel to and abut the first and second side panels, respectively, of the container, and the second parts are spaced apart from the first and second side panels, respectively, of the container and comprise the free ends of the inner frame.

4. The pack of claim 3, wherein the second parts are substantially parallel to the front portion of the inner frame.

5. The pack of claim 3, wherein the second parts are substantially parallel to the rear panel of the container.

6. The pack of claim 3, wherein the second parts abut the rear panel of the lid when the lid is at the closed position.

7. The pack of claim 3, wherein each of the first and second side portions of the inner frame comprises a curved edge or at least one bevelled edge connecting the first and second parts.

8. The pack of claim 3, wherein each of the first and second parts is planar.

9. The pack of claim 1, wherein the front, rear, first side and second side panels of the container and of the lid are planar.

10. The pack of claim 1, wherein respective widths of the front, rear, first side and second side panels of the lid measured between the curved edges of the lid are equal to respective widths of the front, rear, first side and second side panels of the container measured between the curved edges of the container; and wherein respective radii of the curved edges of the lid between the front and first side panels of the lid, the rear and first side panels of the lid, the front and second side panels of the lid, and the rear and second side panels of the lid are equal to respective radii of the curved edges of the container between the front and first side panels of the container, the rear and first side panels of the container, the front and second side panels of the container, and the rear and second side panels of the container.

11. The pack of claim 1, wherein the front portion of the inner frame is substantially parallel to and abuts the front panel of the container.

12. The pack of claim 1, wherein the front portion of the inner frame is affixed to the front panel of the container.

13. The pack of claim 1, wherein the free ends of the inner frame are spaced apart from each other.

14. The pack of claim 1, comprising a bundle of smoking articles in the chamber, wherein the inner frame extends at least partially around the bundle of smoking articles.

15. The pack of claim 14, wherein the bundle comprises the smoking articles and a wrapper extending at least partially around the smoking articles.

16. A plurality of blanks, wherein each of the blanks comprises a sheet of material having one or more predetermined fold lines therein, and wherein the blanks are foldable along the fold lines and locatable relative to each other to form a pack according to claim 1.

* * * * *